US009913517B2

(12) United States Patent
Poon

(10) Patent No.: US 9,913,517 B2
(45) Date of Patent: Mar. 13, 2018

(54) PROTECTIVE DEVICE CASE

(71) Applicant: Griffin Technology, LLC, Irvine, CA (US)

(72) Inventor: Daniel Poon, Nashville, TN (US)

(73) Assignee: Griffin Technology, LLC, Irvine, CA (US)

( * ) Notice: Subject to any disclaimer, the term of this patent is extended or adjusted under 35 U.S.C. 154(b) by 135 days.

(21) Appl. No.: 14/210,448

(22) Filed: Mar. 14, 2014

(65) Prior Publication Data

US 2015/0264822 A1 Sep. 17, 2015
US 2017/0295900 A9 Oct. 19, 2017

Related U.S. Application Data

(60) Provisional application No. 61/782,110, filed on Mar. 14, 2013.

(51) Int. Cl.
*B65D 85/00* (2006.01)
*A45C 11/00* (2006.01)

(52) U.S. Cl.
CPC ..... *A45C 11/00* (2013.01); *A45C 2011/002* (2013.01)

(58) Field of Classification Search
CPC . G06F 1/1628; A45C 2013/02; A45C 13/025; A45C 11/00; A45C 2011/002; H04B 1/3888
USPC ..... 206/320, 38, 701, 316.1, 521, 45.2, 724, 206/576; 455/575.1, 575.8
See application file for complete search history.

(56) References Cited

U.S. PATENT DOCUMENTS 7,933,122 B2 * 4/2011 Richardson ..... H05K 5/068 206/320
8,251,210 B2 * 8/2012 Schmidt ..... H04M 1/04 206/320
8,624,111 B2 * 1/2014 Tages ..... B29C 45/1676 174/50
8,695,798 B2 * 4/2014 Simmer ..... G06F 1/1626 206/320
9,182,785 B2 * 11/2015 Wyner ..... A45C 11/00
2007/0116454 A1 * 5/2007 Tsai ..... G03B 17/17 396/287
2012/0018323 A1 * 1/2012 Johnson ..... H04B 1/3888 206/320
2012/0112031 A1 * 5/2012 Gormick ..... A45C 11/00 248/371

(Continued)

*Primary Examiner* — J. Gregory Pickett
*Assistant Examiner* — Rafael Ortiz
(74) *Attorney, Agent, or Firm* — Manatt, Phelps & Phillips, LLP

(57) ABSTRACT

A protective case for a portable device having a touch screen is constructed from a back frame, a front frame and a stretchable cover. The back frame receives the device through an open front and the stretchable cover is stretched over the back frame and the device. A portion of the cover stretches over the back frame and device such that the device is securely held in the back frame. A front frame with a transparent screen protector that allows the touch screen of the portable device to be used while the device is fully enclosed in the case is removably coupled to the back frame with grasping protrusions or arms that connect to mounting portions on the back frame that extend through openings in the stretchable cover.

18 Claims, 11 Drawing Sheets

(56) References Cited

U.S. PATENT DOCUMENTS

2014/0171150 A1* 6/2014 Hurst ..... H04M 1/04
455/556.1

* cited by examiner

PROTECTIVE DEVICE CASE

CROSS-REFERENCES TO RELATED APPLICATIONS

The present Utility Patent Application is based upon and claims priority from U.S. Provisional Patent Application No. 61/782,110 filed Mar. 14, 2013 entitled "Protective Device Case.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

A wide variety of protective device cases have been invented that provide various levels of protection. One problem with prior art cases is that the more durable, water resistant and protective the case is the more difficult it is to access the enclosed device. In addition, many cases make it difficult to access the various controls and features of the device or fail to adequately protect the controls of the device. These problems are magnified for small touch screen devices that are very sensitive, have a limited display area and may require cleaning. Therefore, what is needed is an improved device case that provides a high degree of protection while allowing easy access to the controls of the enclosed device.

BRIEF SUMMARY OF THE INVENTION

An embodiment of the present invention is directed toward a protective case for a portable device having a touch screen. The case includes a back frame that receives the portable device, a stretchable cover that stretches over at least a portion of the back frame and the portable device when the portable device is in the back frame, and a front frame having a transparent screen protector that mounts over a portion of the stretchable cover and the back frame such that the portable device is held between the back frame and the front frame.

The back frame has an open front and is shaped to receive the portable device. Openings are provided in the back frame for any controls or outputs of the device that covered by the back frame. The back frame preferably is a unitary molded piece that has a screened portion formed in a microphone opening that protects the microphone. The back frame includes a camera flap cavity with sidewalls on an exterior of the back frame that receives a hinged camera flap which removably covers and seals the camera flap cavity. The back frame also includes compression pad cavities on an interior surface of the back frame and compression pads mounted in the compression pad cavities. The compression pads insure a tight compression fit between the device and case. The back frame includes an opening that allows a user to remove the portable device from the back frame by pushing on the back of the device. Raised portions on the back frame extend through openings in the back of the stretchable cover to restrict movement of the stretchable cover with respect to the back frame.

The stretchable cover is constructed so that it can be stretched over the back frame when the device is mounted in the back frame. The cover has tabs and flaps that correspond to the control openings in the back frame and function to removably cover the controls and outputs of the device. When installed over the back frame, the stretchable cover has portions that extend over the portable device mounted in the back frame. These portions of the stretchable cover ensure that the portable device is securely held inside the back frame and stretchable cover.

The stretchable cover includes a recessed front portion that is shaped to receive the front frame when the front frame is mounted on the cover and back frame. The front frame fits in the recessed front portion and clamps over the cover and back frame such that the portable device is securely held between the back frame and the front frame and the touch screen of the portable device is protected and usable while the device is in the case. The stretchable cover also preferably includes bumper portions around the recessed front portion that extend past a front surface of the front frame when the case is assembled and cushion the case in the event of an impact.

The front frame is preferably coupled to the back frame with grasping arms that mate with corresponding mounting portions on the back frame which extend through openings in the stretchable cover. The front frame also preferably has a front frame control opening and the stretchable cover includes a button pad that extends through the control opening. The flexible button pad forms a seal with the rigid front frame control opening and allows a control on the front of the portable device to be operated when the portable device is inside the case. The front frame also preferably includes a speaker opening having a water resistant insert and a camera opening with a transparent camera cover.

The transparent screen protector is preferably mounted on a raised portion on the back of the front frame. The stretchable cover has a corresponding front cavity shaped to receive the raised portion of the front frame and screen protector and form a debris resistant seal.

DETAILED DESCRIPTION OF THE INVENTION

Figure 1:
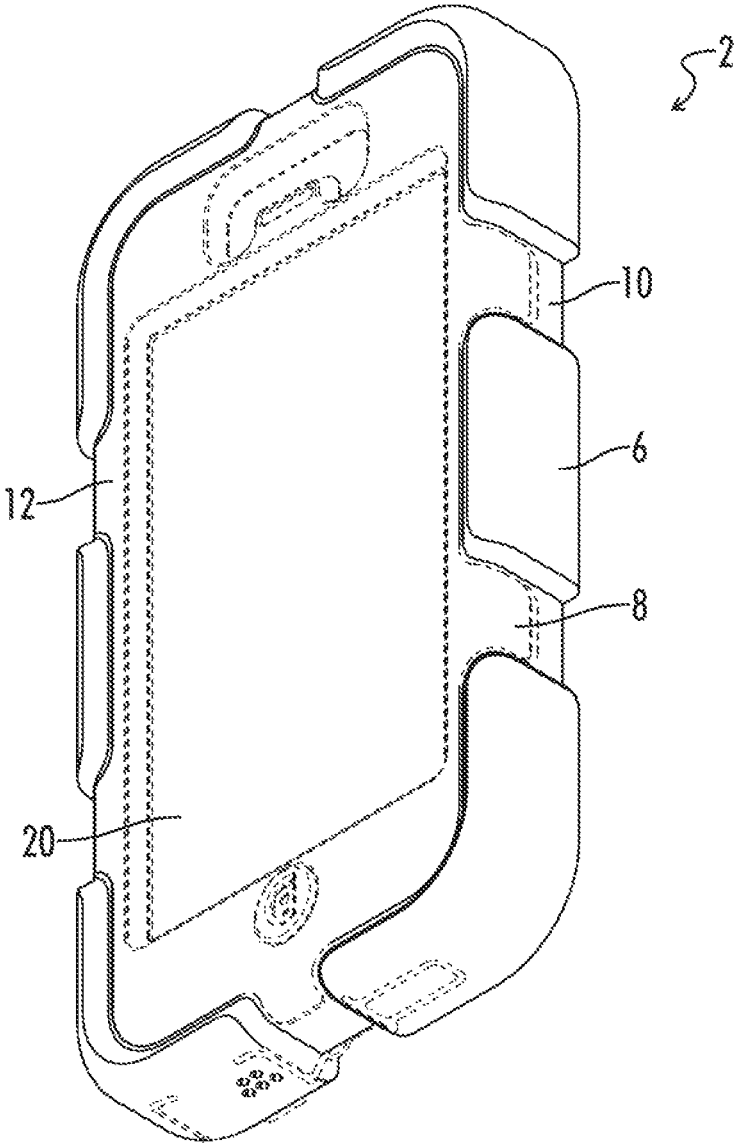
FIG. 1 is an illustration of a device case for a mobile phone constructed in accordance with an embodiment of the present invention.
Figure 2:
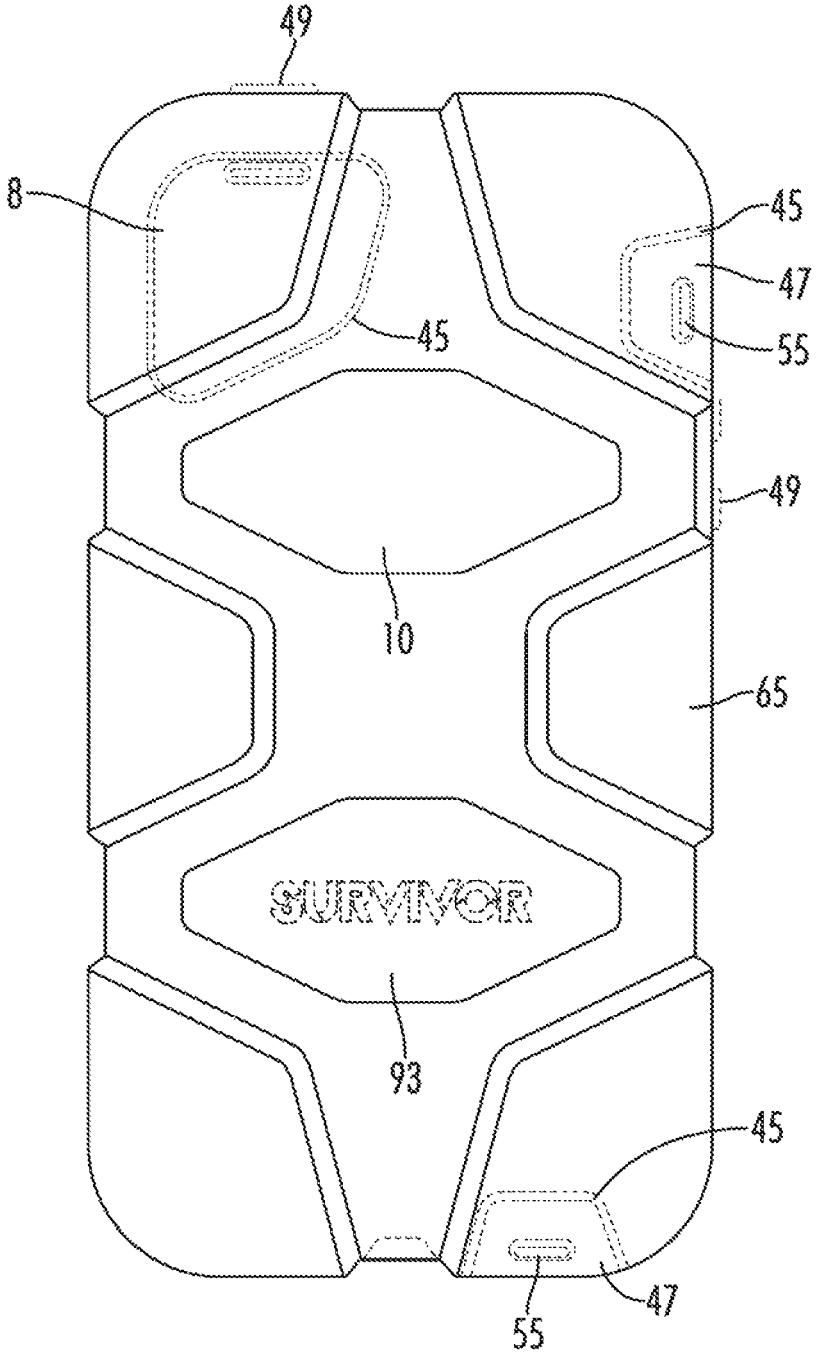
FIG. 2 is a back view of the device case of FIG. 1.
Figure 3:
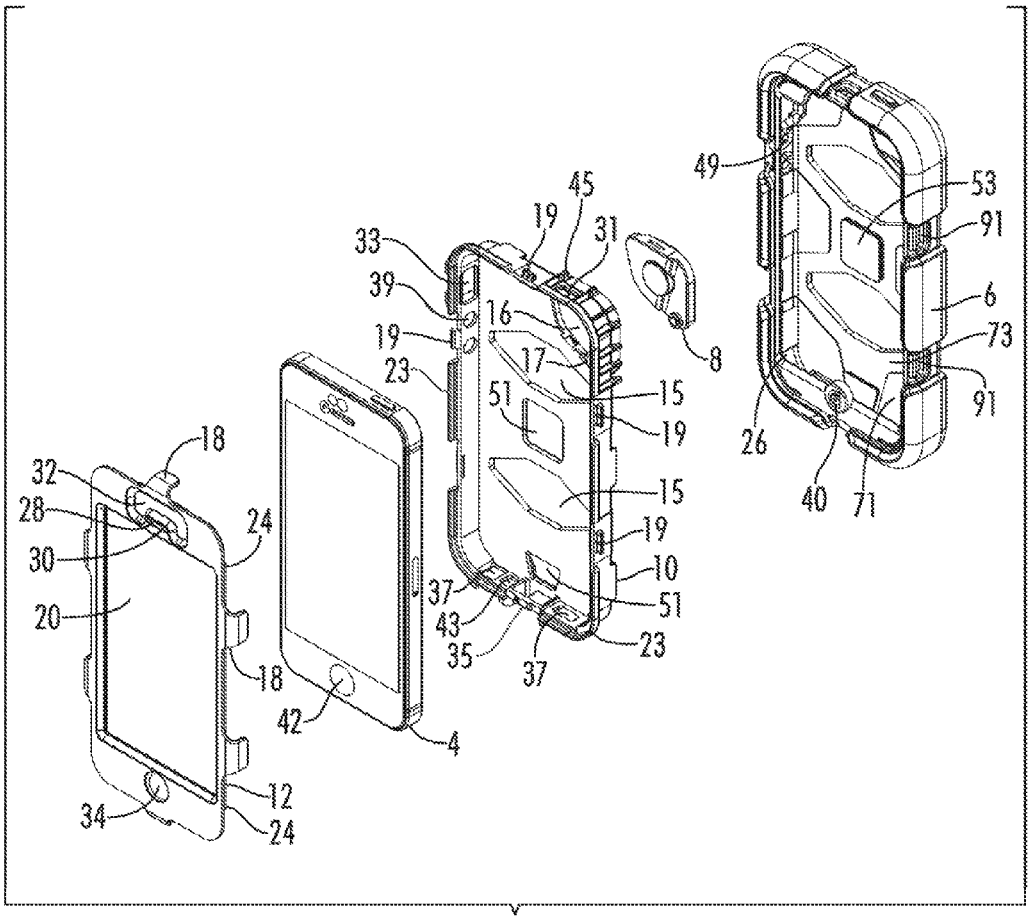
FIG. 3 is an exploded view of the device case and enclosed phone of FIG. 1.

A device case that utilizes the present invention can be adapted for a wide variety of different types of mobile devices. FIG. 1 is a front isometric view of an assembled device case 2 for a phone 4 constructed in accordance with the present invention. FIG. 2 is a back view of the case of FIG. 1 and FIG. 3 is an exploded view of the case of FIG. 1. FIGS. 4-7 illustrate the assembly of the case of FIG. 1 from its components parts.

Figure 4:
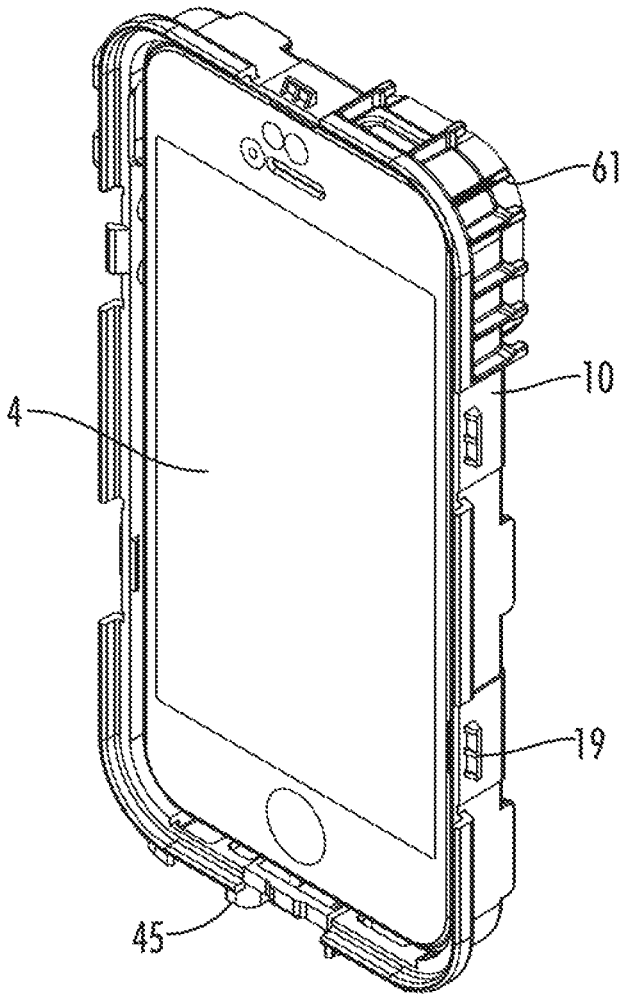
FIG. 4 is an illustration of the back frame of the embodiment of FIG. 1 with the phone inserted into the back frame.
Figure 5:
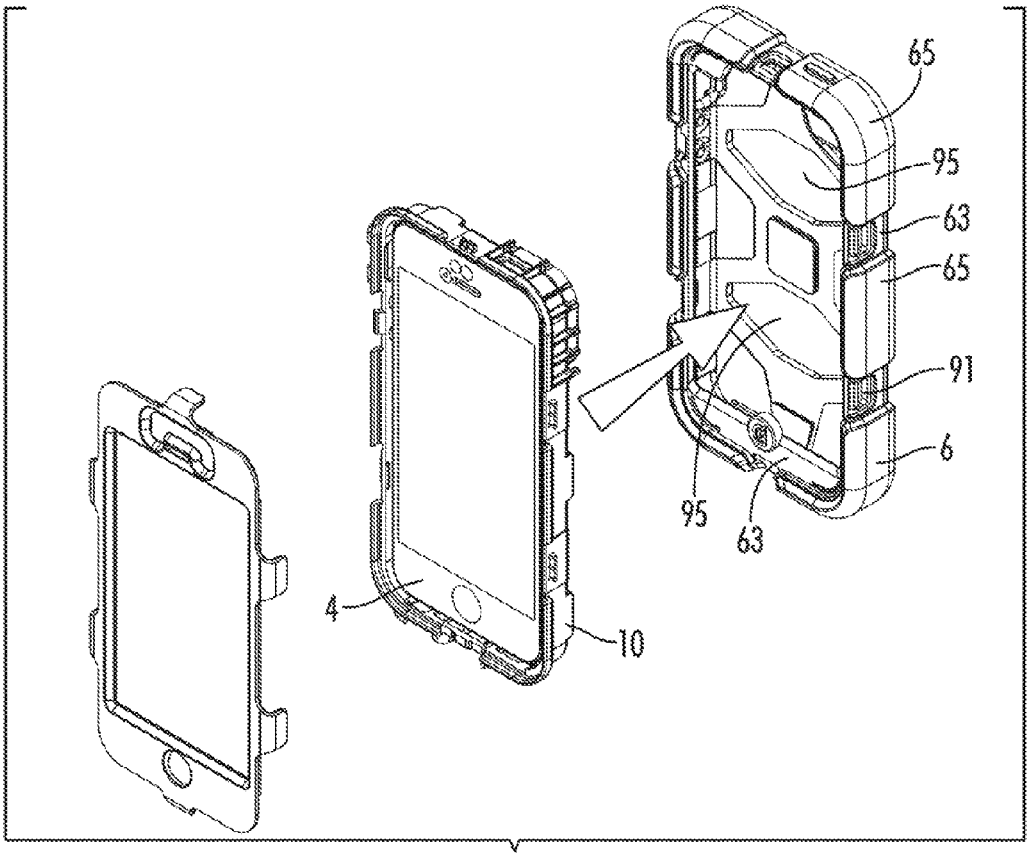
FIG. 5 is an illustration of the insertion of the back frame of the device case of FIG. 1 into the stretchable cover while the phone is positioned in the back frame.
Figure 6:
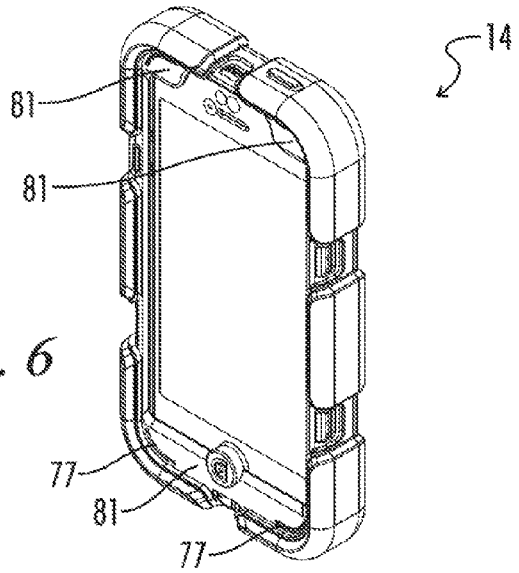
FIG. 6 is an illustration of the back frame of the device case of FIG. 1 inserted into the stretchable cover with the phone held inside.
Figure 7:
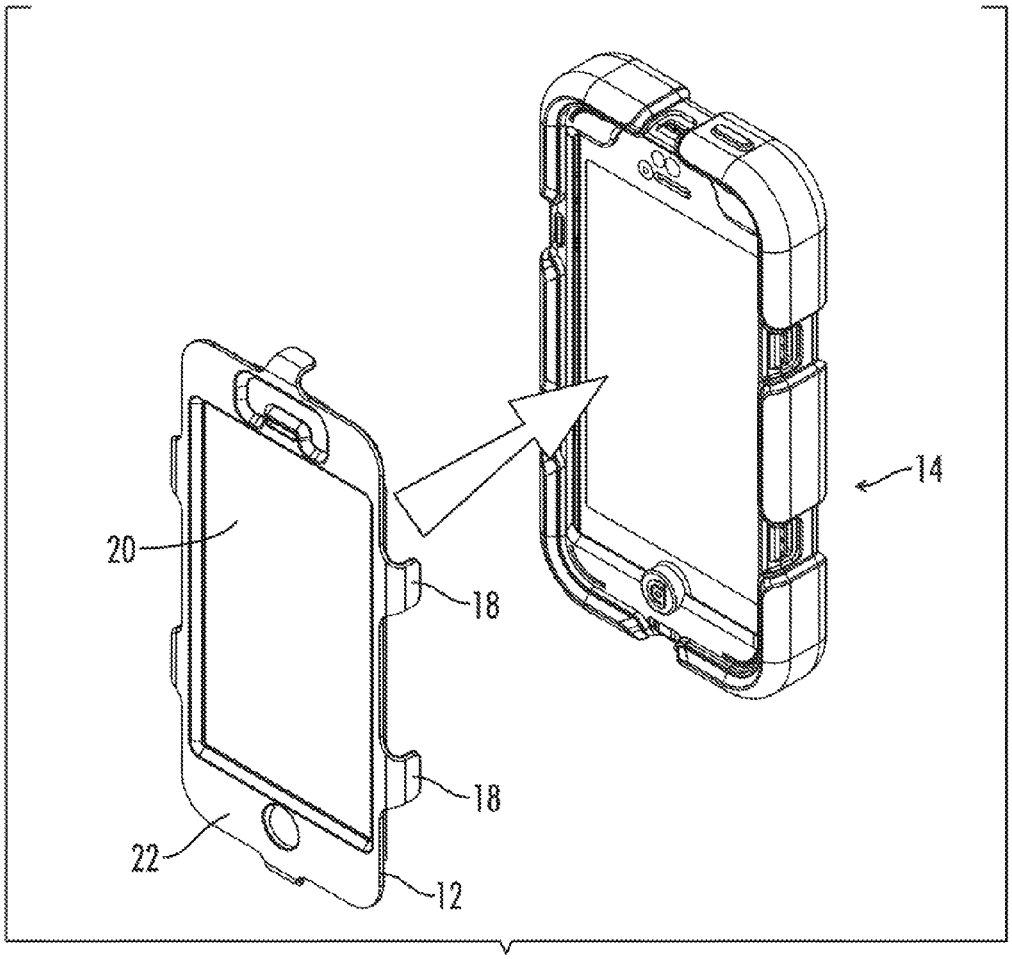
FIG. 7 is an illustration of the clamping of the front frame over the back frame and the stretchable rear cover of the device case of FIG. 1 with the phone enclosed therein.

The protective device case 2 of the present invention is preferably constructed from three basic parts, a rear stretchable silicone rubber cover 6, a rigid plastic back frame 10 and a rigid plastic front frame 12. The embodiment shown in FIGS. 1-7 also has a camera cover 8 to accommodate a digital camera on the back of the enclosed phone 4. To assemble the device case 2, the camera cover 8 is inserted into a shaped camera flap opening 16 in the rigid rear frame 10. The mobile phone 4 is then inserted into the back frame 10 as shown in FIG. 4. Next, as shown in FIG. 5, the rigid back frame 10 with the phone 4 inserted inside is further inserted into the stretchable silicone rubber cover 6 which stretches over the rear frame 10 such that the phone is firmly held inside the rear frame 10 and a unitary assembly 14 is formed as shown in FIG. 6. Finally, the front frame 12 is clamped over the rear frame and stretchable cover assembly 14 with the phone inside as shown in FIG. 7 such that the phone is firmly and securely held inside the completely assembled case 2.

In the embodiment shown, the front frame 12 is coupled to the rear frame 10 by six grasping or clamping protrusions 18 that extend from the sides of the front frame 12. The front frame 12 is preferably constructed a unitary, rigid plastic frame 22 with a transparent screen protector 20 bonded to the frame. The screen protector 20 is mounted on a slightly raised portion 24 on the back of the front frame 12. The raised portion 24 on the back of the front frame 12 tightly fits into a corresponding front opening 26 in the stretchable cover 6 such that a debris and moisture resistant seal is created between the stretchable cover 6 and the front frame 12. The screen protector 20 is preferably bonded to the front frame 12 around its entire periphery such that a water tight seal is formed between the protector and the front frame. A protective speaker cover 28 that allows sound to pass relatively unobstructed is mounted in an opening 30 in the front frame 12 and screen protector 20 to allow a user to hear sound from the phone's microphone while the phone 4 is in the case. An opening 32 in the front frame 12 with a transparent cover is also provided for a camera on the front of the phone 4. Those skilled in the art will appreciate that the precise location and configuration of the speaker, control and camera openings will vary based upon the type of device that the case is designed to enclose.

As best shown in FIG. 3, an opening 34 in the front fame 12 is provided for a control button 42 on the front of the phone 4. The stretchable silicone cover 6 includes a button pad 40 that fits through the opening 34 in the front frame 12. The button pad 40 protects the control button 42 on the front of the phone while allowing it to be used when the phone is enclosed within the case. In addition, the compression fit between the front frame 12 and the back frame 10 creates a protective, debris resistant seal between the relatively rigid button opening 34 and the flexible button pad 40.

The front frame 12 preferably has six grasping or clamping protrusions 18 that engage six mating portions 19 on the back frame 10. The protrusions 18 preferably have a snap fit that firmly secures the front frame 12 to the mating portions 19 of the back frame 10 but can be easily removed by a user engaging the protrusions with their finger nail. In the embodiment shown, this is accomplished with a ridge on the inner surface of the protrusions 18 that engages the mating portions 19 on the back frame 10.

The back frame 10 includes a variety of openings for the controls of the phone 4. These openings include an opening 16 for the camera on the back of the phone 4 and an opening 41 for the camera flap hinge, the power switch 31, the input/output connector 35, two bottom microphones 37, up/down volume buttons 39, head phone jack 43 and the ringer on/off 33. The openings in the rigid back frame 10 that have corresponding plugs 47 or flap covers in the stretchable cover 6 preferably have raised walls 45 surrounding sections of their perimeter that form cavities that receive the corresponding plugs 47 on the stretchable cover 6 to form removable or rotatable covers over the openings that increase their moisture and debris resistance while allowing access to the phone controls underneath. Pads 49 are provided on the interior and exterior of the stretchable cover 6 to assist with activating the control buttons through the stretchable cover. Finger grips 55 are provided on the flaps 47 to assist in their opening.

The back frame 10 includes openings 51 on the back that receive raised portions 53 on the stretchable cover 6. The openings 51 interact with the raised portions 53 to minimize movement of the stretchable cover 6 with respect to the back frame 10. In addition, the openings 51 assist in removing the phone 4 from the back frame 10 when disassembling the case 2. A user can simply insert their finger into the openings 51 to apply pressure to the back of the phone 4 which causes the phone to be separated from the back frame 10, which is preferably precisely sized to form a relatively tight fit with the phone.

Compressible pads are positioned in shaped cavities 15 formed in the back frame 10 when the case is manufactured. The compressible pads insure that the phone is firmly held in the case by compressing when the phone is inserted into the back frame and applying pressure to the back of the phone which holds it firmly in place. The compressible pads 100 are best shown with respect to the embodiment of FIG. 8.

The back frame 10 also includes a mounting opening or cavity 16 that receives the camera flap 8. The camera flap 8 protects a digital camera positioned on the back of the phone 4. The mounting cavity 16 includes a mounting hole 17 that is used to pivotally mount the hinged camera flap 8 so that it can be removed or rotated away from and over the back camera of the phone 4.

Features such as ridges 61 that mate with corresponding cavities on the stretchable cover 6 are provided on the corner of the back frame 10 to further restrict movement of the back frame with respect to the stretchable cover.

The stretchable cover 6 is pulled over the back frame 10 with the phone 4 inserted such that the phone is held in place by the stretchable cover. The stretchable cover 6 has a sunken or recessed front portion 63 that corresponds to the shape of the front frame 12. The sunken front portion 63 of the stretchable cover 6 is surrounded by raised ridges that form bumpers 65 that protect the relatively rigid front frame 12 and cushion the case 2 if it is dropped. The interior of the stretchable cover 6 includes depressions 73 and raised portions 71 that correspond with depressions and raised portions on the back of the back frame 10 such that the stretchable cover grips and is fixed with respect to the rigid back frame. Channels on the underside of the stretchable cover 6 surrounding the front perimeter of the back frame 10 mate with corresponding raised extensions 23 on the front perimeter of the back frame 10 to secure the back frame with respect to the cover.

The stretchable cover includes a button pad 40 that fits through the opening 34 in the front frame 12. The button pad 40 protects the control button 42 on the front of the phone while allowing it to be used when the phone is enclosed within the case 2. In addition, the compression fit between the front frame 12 and the back frame 10 creates a water resistant seal between the button opening 34 and the button pad 40.

The stretchable cover also has six openings 91, two on each side and one on the top and bottom, that correspond to the grasping arms 18 on the front frame 12 and through which the mounting portions 19 on the back frame 10 extend.

Portions 81 of the stretchable cover 6 extend over the back frame 10 and the front of the phone 4 when the phone is mounted in the back frame and the stretchable cover stretched over the phone and back frame. These portions 81 hold the phone in the back frame 10 and stretchable cover 6 when the front frame 12 is removed. This configuration allows the touch screen of the phone to be cleaned and accessed without fully disassembling the case or removing the phone. Depressions, channels, grooves or similar features 77 are provided on the portions of the stretchable cover that extend over the phone. These features 77 mate with corresponding features on the underside of the front frame 12 to further secure the front frame to the stretchable cover 6.

Raised shapes 93 formed on the back of the back frame 10 extend through openings 95 in the stretchable cover 6. As well as adding to the visual appearance of the case, these features 93 and 95 help prevent the stretchable cover 6 from moving with respect to back frame 10. The stretchable cover 6 also includes raised portions 65 that extend beyond the back frame 10 to cushion the case in the event it is dropped. As shown in the embodiment of FIG. 2, the raised shapes 93 are octagons.

Figure 8:
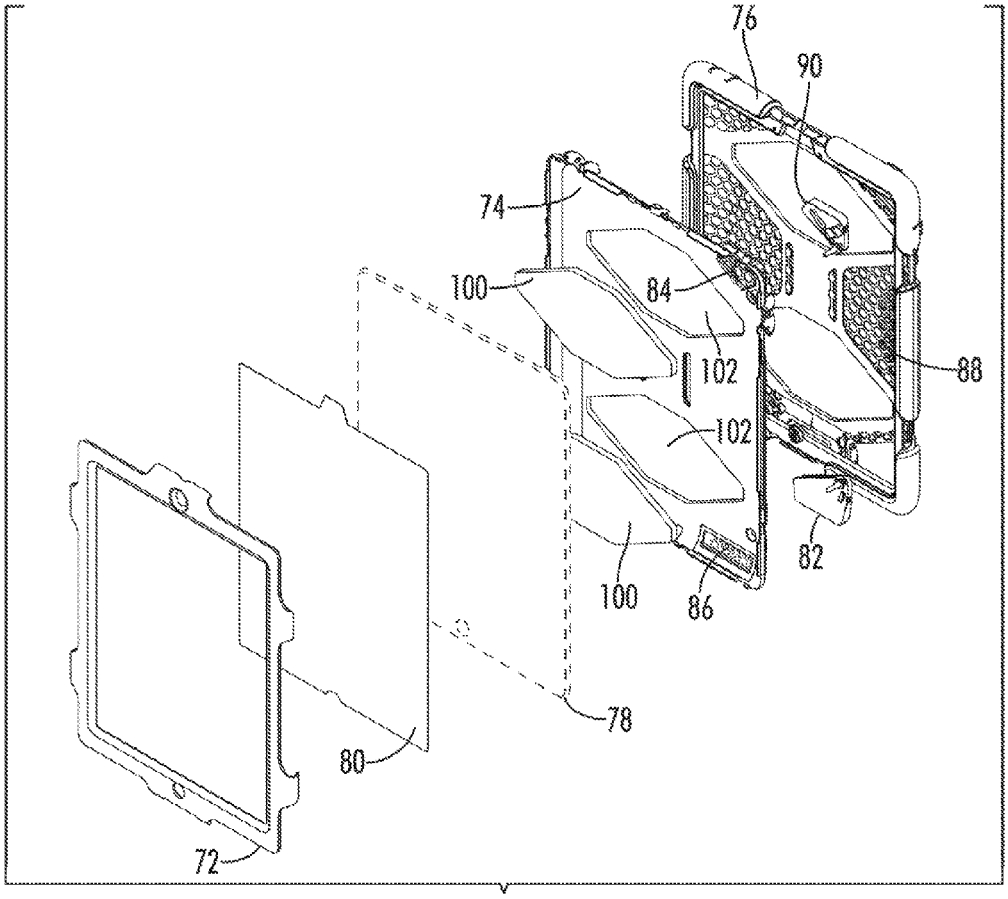
FIG. 8 is an exploded view of an unassembled device case for a tablet computer constructed in accordance with another embodiment of the present invention.
Figure 9:
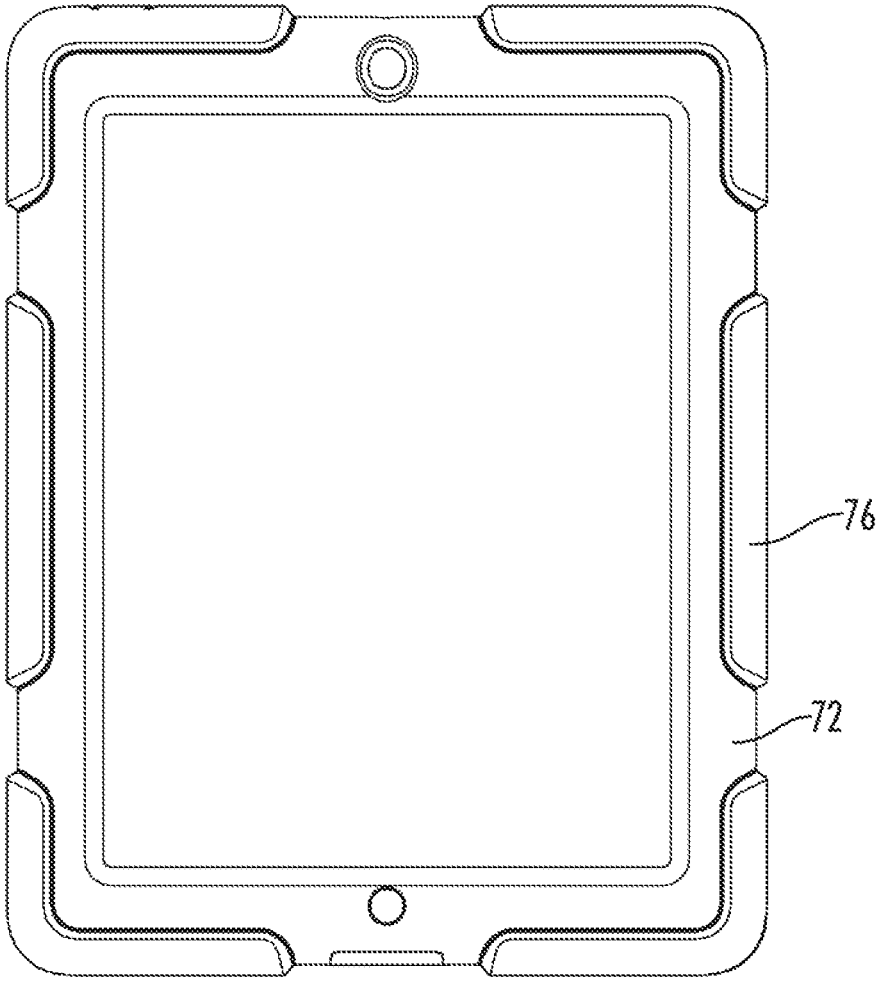
FIG. 9 is an illustration of a front view of the assembled device case of FIG. 8.
Figure 10:
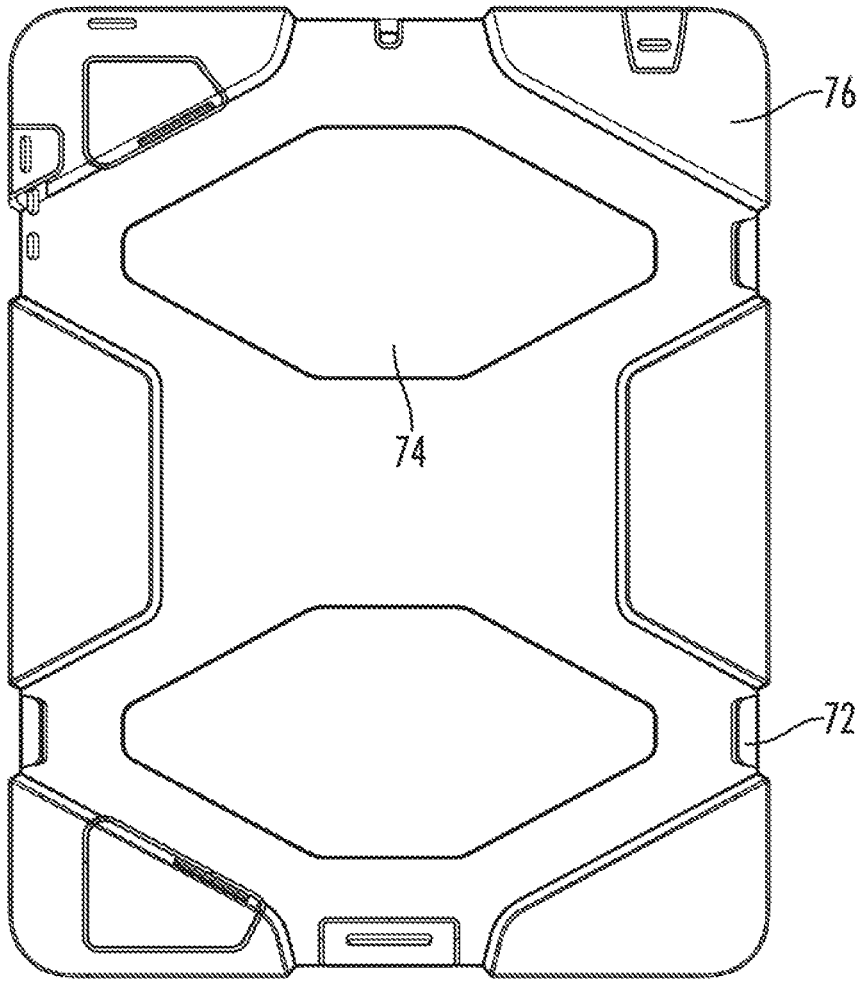
FIG. 10 is an illustration of a back view of the assembled device case of FIG. 8.

Referring now to FIG. 8, an exploded view of an unassembled device case for a tablet computer 78 constructed in accordance with an embodiment of the present invention is shown. FIG. 9 is an illustration of a front view of the assembled device case of FIG. 8 and FIG. 10 is an illustration of a back view of the device case of FIG. 9. The figures demonstrate how the concepts of the present protective case design can be adapted for a variety of different types of devices. The case again includes a front frame 72, back frame 74 and stretchable cover 76 which enclose the tablet computer 78. The touch screen 80 is shown in FIG. 8 prior to being bonded to the raised portion on the back of the front frame 72 as discussed above with respect to the embodiment of FIG. 1.

The case has a hinged camera cover 90 that allows unobstructed access to the camera of the tablet 78 though an opening 84 in the back frame 74 while retaining the protective properties of the case. The tablet computer embodiment of the case shown FIG. 7 also uses a hinged cover 82 for the larger speaker of the tablet computer 78 which is accessed through a screen 86 formed in the plastic of the single piece back frame 74.

Compressible pads 100 are positioned in trapezoidal cavities 102 formed in the back frame 74. The compressible pads 100 insure that the tablet computer 78 fits securely in the case without moving by applying a constant pressure to a device installed in the case. The stretchable cover 76 also has a honey comb structure of cavities 88 formed in its back section which increases the cushioning effect of the silicone rubber.

Figure 11:
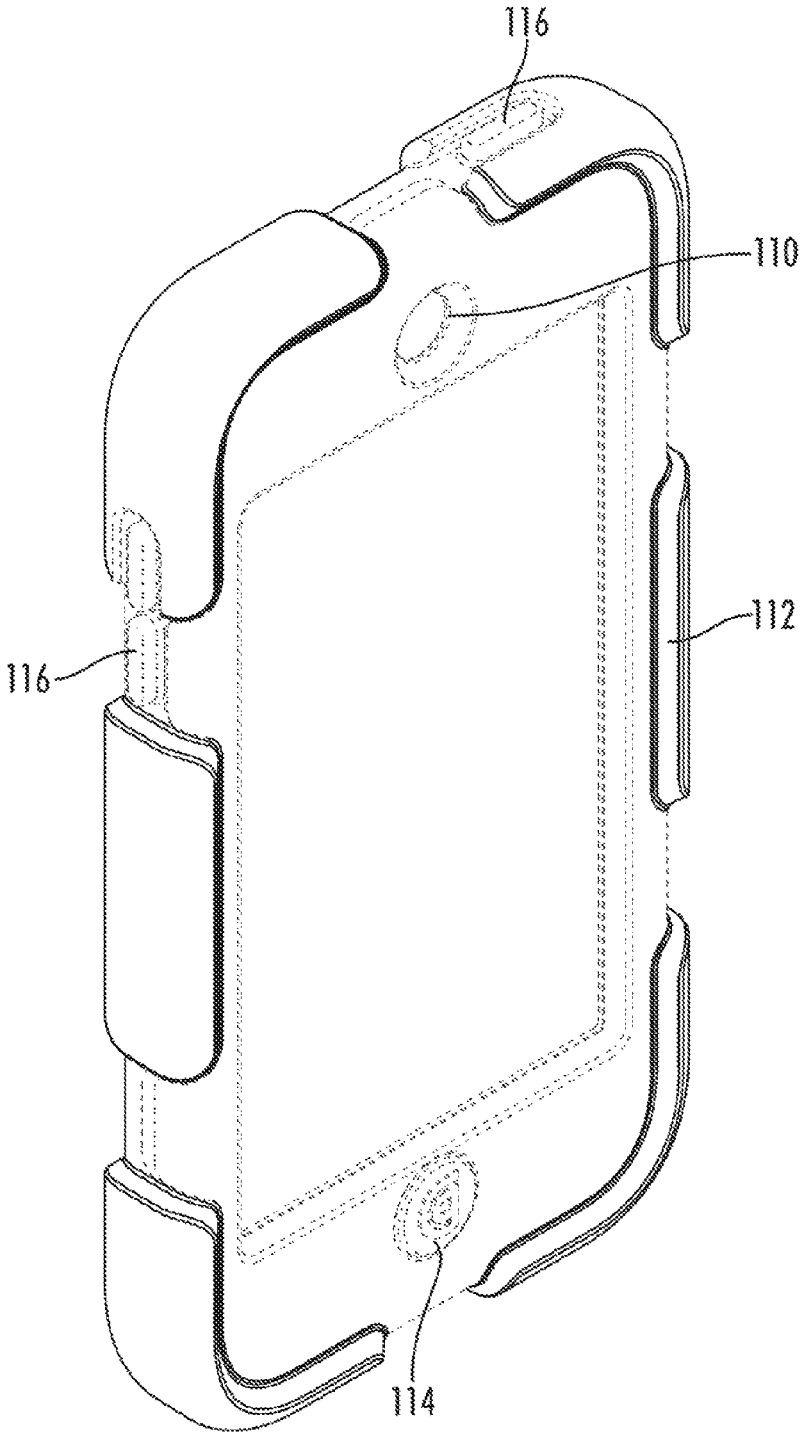
FIG. 11 is an isometric front view of an assembled device case for a touch screen digital music player constructed in accordance with another embodiment of the present invention.

FIG. 11 is an isometric front view of an assembled device case for a touch screen digital music player constructed in accordance with another embodiment of the present invention. The figure further illustrates how aspects of the present invention such as the front frame camera opening 110, cover bumpers 112, front frame button opening and cover 114 and control covers 116 can be reconfigured to accommodate almost any particular device.

Figure 12:
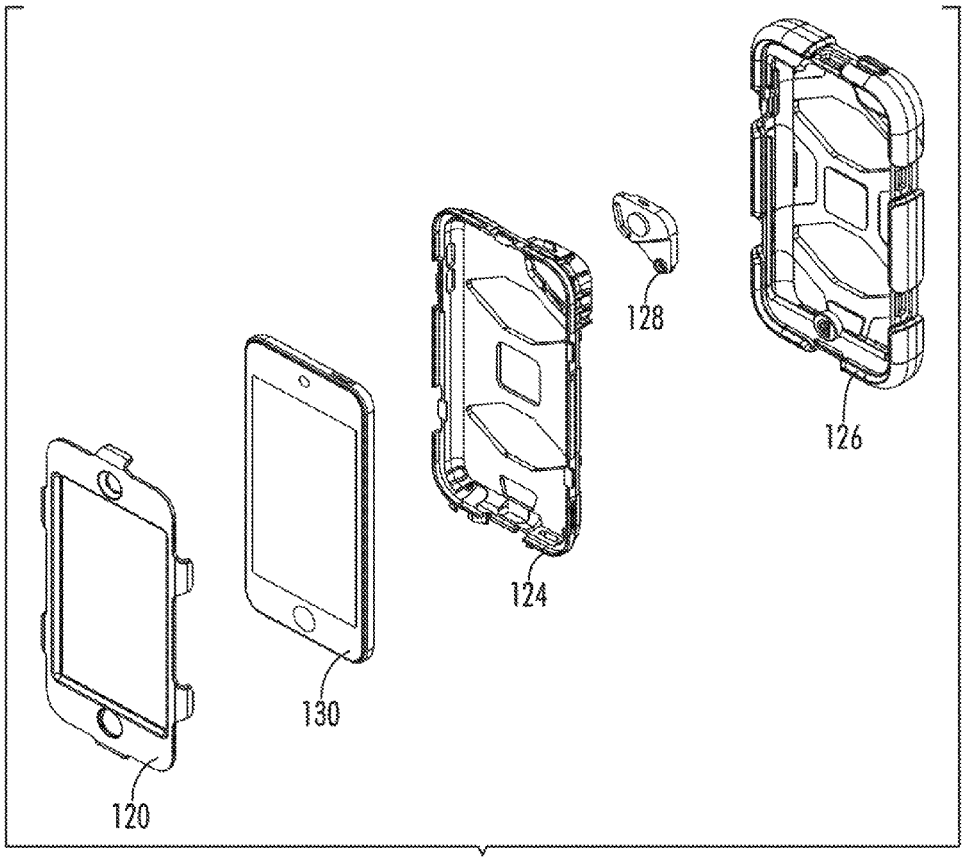
FIG. 12 is an exploded view of the unassembled device case of FIG. 11.

FIG. 12 is an exploded view of the case of FIG. 11 which illustrates the three main components of an unassembled device case for a touch screen digital music player. The components include a back frame 124 that receives the digital music player 130, a stretchable cover 126 that stretches over the back frame 124 and digital music player 130, and a front frame 120 that clamps over the player, back frame and cover. A hinged camera flap 128 is also provided that is mounted in the back frame 124.

Although there have been described particular embodiments of the present invention of a new and useful Protective Device Case, it is not intended that such references be construed as limitations upon the scope of this invention except as set forth in the following claims.

What is claimed is:

1. A case for a portable device having a touch screen, said case comprising:

a back frame that receives the portable device;

a stretchable cover that stretches over at least a portion of said back frame and said portable device when said portable device is in said back frame; and a front frame having a transparent screen protector, wherein said front frame clamps over a portion of said stretchable cover and said back frame such that said portable device is held between said back frame and said front frame while said portable device is in said case, wherein said front frame further comprises an opening and said stretchable cover includes a button pad on said stretchable cover such that when said stretchable cover is stretched over said back frame, and said front frame is clamped over said stretchable cover and said back frame, said button pad fits in said opening.

2. The case of claim 1 wherein said front frame further comprises at least one grasping protrusion that mates with a corresponding mounting portion on said back frame.

3. The case of claim 2 wherein said stretchable cover includes a mounting opening and said mounting portion on said back frame extends through said mounting opening.

4. The case of claim 1 wherein said back frame includes raised shapes formed on the back of the back frame and extending through openings in the stretchable cover, wherein the raised shapes are octagons.

5. The case of claim 1 wherein said back frame includes a cavity on an interior surface of said back frame and a compressible pad mounted in said cavity, wherein when the portable device is inserted into the back frame, the compressible pad applies pressure to the back of the portable device.

6. The case of claim 1 wherein said back frame includes an opening that allows a user to remove said portable device from said back frame.

7. The case of claim 1 wherein said stretchable cover extends over said portable device when said portable device is mounted in said back frame and said stretchable cover is stretched over said back frame such that said portable device is held inside said back frame and stretchable cover.

8. The case of claim 1 wherein said back frame includes raised portions that extend through openings in a back of said stretchable cover that restrict movement of said stretchable cover with respect to said back frame.

9. The case of claim 1 wherein said back frame further comprises a screen formed in a microphone opening in said back frame.

10. The case of claim 1 wherein said front frame further comprises an opening for a speaker having a water resistant insert.

11. A case for a portable device having a touch screen, said case comprising:

a back frame shaped to receive the portable device such that a front of said portable device does not touch said back frame;

a stretchable cover that stretches over at least a portion of said back frame and said portable device when said portable device is mounted in said back frame; and a front frame having a transparent screen protector, wherein said front frame clamps over a portion of said stretchable cover and said back frame such that said portable device is held between said back frame and said front frame, wherein said front frame further comprises an opening and said stretchable cover includes a button pad on said stretchable cover such that when said stretchable cover is stretched over said back frame, and said front frame is clamped over said stretchable cover and said back frame, said button pad fits in said opening.

12. The case of claim 11 wherein said front frame further comprises a raised portion and said transparent screen protector is mounted on said raised portion.

13. The case of claim 12 wherein said stretchable cover further comprises a front cavity shaped to receive said raised portion of said front frame to form a water resistant seal.

14. The case of claim 11 wherein said back frame further comprises a cavity on an interior surface of said back frame and a compressible pad mounted in said cavity, wherein when the portable device is inserted into the back frame, the compressible pad applies pressure to the back of the portable device.

15. The case of claim 11 wherein said front frame further comprises at least one grasping protrusion that mates with a corresponding mounting portion on said back frame.

16. The case of claim 11 wherein said stretchable cover further comprises bumper portions that extend past a front surface of said front frame when said front frame is coupled to said back frame.

17. The case of claim 11 wherein said stretchable cover further comprises a recessed sunken front portion that is shaped to receive said front frame when said front frame is mounted on said back frame.

18. A case for a portable device having a touch screen, said case comprising:

a back frame that receives the portable device, said back frame comprising:

at least one mounting portion;

a back frame opening for a control of the device;

a cavity on an interior surface of said back frame; and an opening that allows a user to push said portable device from said back frame;

a stretchable cover, said stretchable cover comprising:

a portion that stretches over said back frame and said portable device when said portable device is in said back frame such that said portable device is held in said back frame;

a button pad on said stretchable cover; and a mounting opening through which said mounting portion on said back frame extends when said stretchable cover is stretched over said back frame;

a front frame that clamps over said stretchable cover and said back frame, said front frame comprising:

a transparent screen protector that allows said touch screen of said portable device can be used while said portable device is in said case;

at least one grasping protrusion that couples to said at least one mounting portion on said back frame such that said portable device is held between said back frame and said front frame and a seal is created between said front frame and said stretchable cover; and an opening in said front frame that receives said button pad on said stretchable cover when said device case is assembled such that a seal is created between said stretchable cover and said front frame around said opening in said front frame;

a compressible pad sized to fit in said cavity on said interior surface of said back frame.

* * * * *